United States Patent [19]

Meiller

[11] Patent Number: 4,842,333

[45] Date of Patent: Jun. 27, 1989

[54] SEAT

[75] Inventor: Hermann Meiller, Amberg, Fed. Rep. of Germany

[73] Assignee: Grammer Sitzsysteme GmbH, Amberg, Fed. Rep. of Germany

[21] Appl. No.: 224,750

[22] Filed: Jul. 27, 1988

[30] Foreign Application Priority Data

Aug. 14, 1987 [EP] European Pat. Off. ..... 87111789

[51] Int. Cl.[4] ..... A47C 1/02

[52] U.S. Cl. ..... 297/318; 297/90; 297/329

[58] Field of Search ..... 297/90, 91, 329, 317, 297/318, 325

[56] References Cited

U.S. PATENT DOCUMENTS

| | | | |
|---|---|---|---|
| Re. 30,648 | 1/1981 | Ohlrogge | 297/318 |
| 2,925,122 | 2/1960 | Winick | 297/318 |
| 2,976,868 | 3/1961 | Weissenberg | 297/90 X |
| 3,039,821 | 6/1962 | Black et al. | 297/343 |
| 3,284,134 | 11/1966 | Malitte | 297/329 |
| 3,913,152 | 10/1975 | Quackenbush | 297/318 X |
| 4,167,288 | 9/1979 | Kiang | 297/378 |
| 4,362,336 | 12/1982 | Zapf | 297/317 |
| 4,765,679 | 8/1988 | Lanuzzi | 297/91 X |

FOREIGN PATENT DOCUMENTS

| | | |
|---|---|---|
| 22933 | 6/1980 | Fed. Rep. of Germany . |
| 35412991 | 11/1985 | Fed. Rep. of Germany . |
| 229625 | 1/1987 | Fed. Rep. of Germany . |

*Primary Examiner*—James T. McCall

*Attorney, Agent, or Firm*—Hoffmann & Baron

[57] ABSTRACT

In a seat having a support frame consisting of a seat portion frame and a backrest portion frame, the backrest portion frame is of a generally L-shaped configuration, with a first limb thereof extending under the seat portion frame. The first limb of the L-shape carries a pivot axis means which is disposed slidably in a pair of rails fixed at the underside of the seat portion frame while the first limb of the L-shaped backrest portion frame is further guided in a second pair of rails at another position spaced from the first pair of rails in such a way that upon forward movement of the seat portion frame the upper end of the backrest portion frame moves in the opposite direction and also moves downwardly, thereby increasing the angle of inclination of the backrest portion, and vice-versa.

16 Claims, 7 Drawing Sheets

SEAT

BACKGROUND OF THE INVENTION

The present invention generally concerns a seat such as a working seat, for example an office chair or a vehicle seat.

In a seat as disclosed in European patent No. 0 022 933, the seat comprises a seat frame structure comprising a seat portion carrier and a backrest portion carrier with the backrest portion carrier of a generally L-shaped configuration in side view. One limb of the L-shaped backrest carrier, which is disposed substantially horizontally, extends under the seat portion carrier and is pivotably connected thereto, at the underside thereof, by means of a pivot shaft or spindle. The angle of inclination of the backrest can be adjusted, relative to the seat portion, by means of a gas spring which is operatively disposed between the base assembly of the seat and the limb of the L-shaped backrest portion carrier which engages under the seat portion carrier. The gas spring has to be operated by means of a suitable lever, for the purposes of adjusting the angle of inclination of the backrest portion.

In another form of seat in which the backrest portion carrier is also pivotable relative to the seat portion carrier for adjusting the angle of inclination of the former, the backrest portion carrier is supported by spring means so that the angle of inclination of the backrest portion adapts itself to the respective seating position in the seat. Although such a seat has the advantage that there is no need for any manual actuating operation for the purposes of adjusting the angle of inclination of the backrest portion, it does however suffer from the disadvantage that the backrest portion does not offer a rigid support to the occupant of the seat. Because the backrest portion has a tendency to yield to a force applied thereto, as for example when the occupant of the seat leans back and applies considerable weight to the backrest portion, so that the backrest portion does not firmly support the back of the occupant, the seat affords a 'spongey' feel to the occupant, and a resulting impression of insecurity.

In yet another form of seat or chair having an adjustable backrest portion such as seats for use in rail vehicles, the backrest portion carrier is pivotable relative to the seat portion or squab carrier about a pivot axis which is disposed at the rearward end of the seat portion carrier, so that the backrest portion pivots relative to the seat portion in the manner of a folding knife. In that case the backrest portion carrier is not of the L-shaped configuration in side view as referred to above, but in essence only consists of a single limb, thus defining a generally planar frame construction. The seat portion carrier and the backrest portion carrier are guided in mounting rails in such a way that, upon a forward movement of the seat carrier portion, the backrest carrier portion is tilted backwards towards a position in which it extends horizontally, until the seat forms a couch arrangement in a fully reclining position. In that operation, the upper end of the backrest portion carrier moves vertically downwardly so that at the end of the reclining movement the seat portion has been moved forwardly by the length of the backrest carrier. A travel seat of that nature is to be found in German patent No. 2 054 817.

A seat as described in the foregoing paragraph is basically not suitable for use as a working seat or chair, for example in the form of an office chair, because the forward movement of the seat portion carrier which is necessary to provide a given angle of inclination of the backrest portion is excessive. In that seat, inclining of the backrest portion and thus the back of the occupant of the seat is achieved solely by the occupant sliding forward, together with the seat portion, by a suitably long distance. If that design principle were to be applied to a seat such as an office chair, the result would be that the occupant of the seat would have to push the office chair backwards by a correspondingly long distance in order not to alter the distance between the occupant of the seat and a surface such as a desk or working table at which that person was seated. Furthermore, the chair would have to be supported on the ground or floor by means of a support base assembly of very substantial dimensions in a horizontal direction so that, when the backrest portion was set into a fairly substantial angle of inclination, the chair would not become unstable on its base assembly by virtue of the long horizontal distance by which the centre of gravity of the seating configuration would be displaced relative to the base assembly.

SUMMARY OF THE INVENTION

An object of the invention is to provide a seat with adjustable seat and backrest portions, which permits easy and convenient adjustment of the seating posture therein.

Another object of the invention is to provide a seat having an adjustable backrest wherein the backrest can be adjusted without manual operation solely by a change in the position of the occupant of the seat.

Still another object of the invention is to provide a chair having a backrest portion which can be adjusted in respect of its angle of inclination without complicated adjusting movements on the part of the occupant and which nonetheless provides firm support for the back of the occupant of the seat at any position of inclination thereof.

Still a further object of the present invention is to provide a frame assembly for a seat including an adjustable backrest portion, which permits ready adjustment of the backrest portion in a convenient and at least substantially foolproof manner.

In accordance with the present invention, those and other objects are achieved by a seat such as a working seat, for example an office chair or a vehicle seat, comprising a seat carrier means and a backrest carrier means which is L-shaped in side view providing first and second limb portions defining the L-shape. One limb portion of the backrest carrier means extends under the seat carrier means at a spacing therefrom. For the purposes of adjustment of the angle of inclination of the backrest portion relative to the seat portion, disposed at the underside of the seat carrier means is a pair of rails adapted slidably to accommodate pivot axis means fixed to the one limb portion of the backrest carrier means which extends under the seat carrier means. That first limb portion of the backrest carrier means is further guided by a guide means disposed at a spacing from the first-mentioned pair of rails, the arrangement being such that, upon a forward movement of the seat carrier means, the free end of the second limb portion of the backrest carrier means, being therefore the top end of the backrest carrier means, moves in a rearward direction and downwardly, and vice-versa.

In such a seat, as will be seen in greater detail hereinafter, the angle of inclination of the backrest carrier means is positively fixedly preset relative to the seat carrier means, in each position of the seat carrier means, thus avoiding any 'spongey' feel for the occupant of the seat when leaning back against the backrest portion of the seat. The movement of the backrest portion for increasing or reducing the angle of inclination thereof is in effect divided between the seat carrier means and the backrest carrier means. Accordingly, the top end of the backrest moves in the opposite direction to the horizontal movement of the seat portion so that, in comparison with the travel seat referred to above, as disclosed in German patent No. 2 054 817, the amount of forward movement of the seat portion in order to produce the same angle of inclination of the backrest portion is considerably less. That means on the one hand that the centre of gravity of the seat configuration scarcely moves in position so that such a seat does not require an extensive base assembly to provide adequate support therefor and can thus also easily be in the form of an office chair, while on the other hand, the point of pivotal movement about which the occupant of the seat pivots when adjusting the angle of inclination of the backrest portion can be kept at a practically stationary location, in the vicinity of the abdomen of the occupant of the seat, as a result of which the distance of the occupant of the seat from a working surface such as a desk or the like remains practically unaltered when the angle of inclination of the backrest portion of the seat is changed.

Furthermore, as will become clearly apparent herein, the mechanism involved in the seat in accordance with the principles of the present invention, which provides for adjustment of the angle of inclination of the backrest portion, should be emphasised as being basically a simple one, while another advantage is that the guide mounting means which support the backrest carrier means relative to the seat carrier means are all disposed beneath the latter so that they are not obtrusive.

The invention therefore provides a seat or chair in which the angle of inclination of the backrest portion is automatically adjusted when the occupant of the seat or chair, together with the seat portion supporting the occupant, moves a short distance forwards or backwards. In addition to that easy and convenient adjusting movement, with the above-mentioned advantage that the pivot point about which the occupant of the seat pivots when adjusting the backrest inclination can be at a substantially stationary location at lower chest or abdomen height, at a short spacing in front of the occupant of the seat, the seat also provides a firm and rigid supporting action for the back of the occupant.

In a preferred feature of the invention, the axis of pivotal movement as between the seat carrier means and the backrest carrier means, which is provided by the interengagement of the pivot means into the first-mentioned pair of mounting rails, is spaced from the rearward end of the seat carrier means by a distance such that the point of rotary movement between the seat carrier means and the second limb portion of the L-shaped backrest carrier means, which limb is generally upright and forms the actual part of the backrest carrier means which carries the backrest portion of the seat, is in a region in which the point of rotation of the back of the occupant of the seat is to be found upon a change in the angle of inclination of the back. By virtue of that structural relationship, when the occupant of the seat inclines the backrest portion rearwardly and remains sitting in the seat with his or her back leaning against the backrest portion, the occupant of the seat does not suffer from the problem of his or her shirt or blouse or like garment being pulled out of a lower garment such as a skirt or a pair of trousers. That effect which occurs when using a seat in which the point of pivotal movement between the seat squab surface and the backrest portion is disposed precisely at the location at which those two parts of the seat come together can be explained by virtue of the point of pivotal movement of the back of the occupant of the seat being located at the buttocks or pelvic region of the occupant of the seat, at a spacing from the actual backrest portion of the seat, so that, when the angle of inclination of the backrest portion of the seat is altered, a point on the back of the occupant of the seat describes a larger radius about the point of rotary movement of the back of the occupant, than the same point of the backrest carrier means pivoting about the point of pivotal movement thereof.

In another preferred feature of the invention, the pair of rails which provide for pivotal and sliding mounting of the backrest carrier means on the seat carrier means is adjustable in its angle of inclination. It will be appreciated that, by virtue of that construction, it is possible to alter the distance that the backrest carrier means and in particular the top end thereof covers when the angle of inclination of the backrest portion is altered. More particularly, the arrangement may be such that, when the pair of rails is at a first adjusted position, an alteration in the angle of inclination of the backrest portion causes the top end of the backrest portion to be displaced rearwardly while the seat carrier means is moved forwardly (in other words the change in the angle of inclination is split up into two opposite directions of movement) whereas when the pair of rails is in another adjusted position, a change in the angle of inclination of the backrest portion does not cause the top end of the backrest carrier means to be moved rearwardly but moves downwardly along a vertical line. Accordingly, by making the effective angle of inclination of the pair of rails adjustable, the invention provides a seat which can be used for example in passenger conveyance vehicles such as a railway carriage in a situation where rows of seats are arranged one behind the other and it is desirable for the point of pivotal movement about which the occupant of a seat pivots upon an adjustment in the angle of inclination of the backrest portion of the seat to remain practically unaltered, while the seat can also be used in a passenger conveyance vehicle such as a railway carriage in a situation which involves the seat being disposed in a compartment, with the seat placed against a wall of the compartment so that in that case the backrest portion thereof can no longer be moved rearwardly, being prevented from doing so by the adjacent compartment wall.

In another advantageous feature of the invention the first limb portion of the backrest carrier means, which therefore extends under the seat carrier means, is guided at the above-mentioned guide means, in a second pair of rails.

Preferably, the seat carrier means is also guided and supported at a location spaced from the first-mentioned pair of guide rails. The guide means at that location preferably comprises a stationary support member which in a particularly preferred embodiment may be a rotatable roller on which the seat carrier means is disposed with its front end which is therefore remote from the first-mentioned pair of guide rails.

In another preferred feature of the invention, the first limb of the backrest carrier means, which therefore engages under the seat carrier means, carries guide projections which may desirably be in the form of guide rollers, which slidably engage into the respective rails to provide for the sliding and adjusting movements of the backrest portion and the seat portion relative to each other.

Further objects, features and advantages of the seat in accordance with the present invention will be apparent from the following description of a preferred embodiment thereof.

DESCRIPTION OF THE PREFERRED EMBODIMENT

Figure 1:
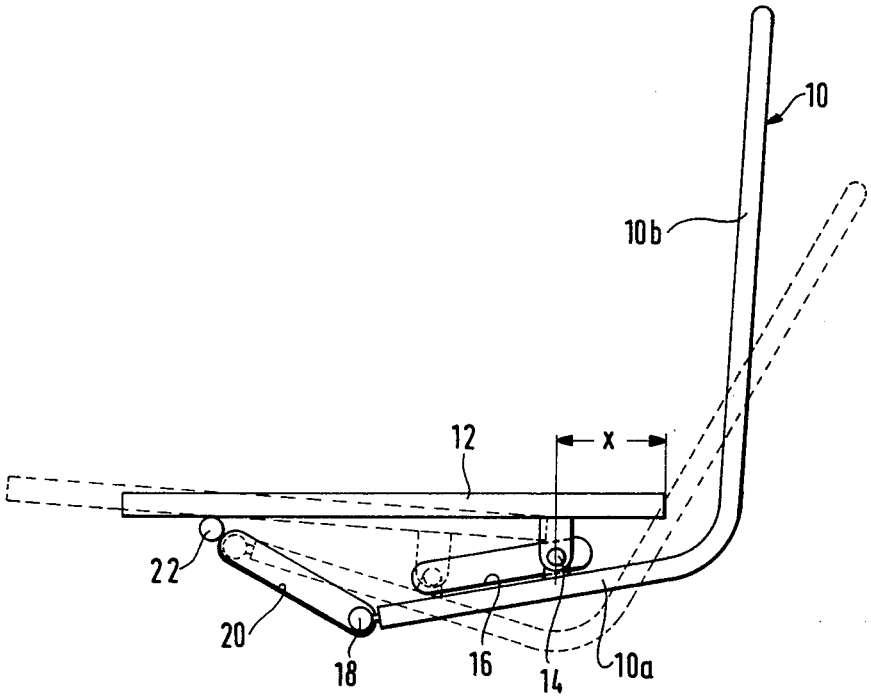
FIG. 1 is a diagrammatic side view of the seat in accordance with the invention, in first and second positions thereof.

Reference will first be made to FIG. 1 showing a generally diagrammatic view of the basic principle of a seat frame assembly of a seat in accordance with the teachings of the present invention. As shown in FIG. 1, the seat frame assembly comprises a backrest portion carrier or frame structure 10 which is of a generally L-shape and a seat portion carrier or frame structure 12. The carrier 10 comprises first and second limbs 10*a* and 10*b* respectively, with the lower limb 10*a* extending generally horizontally and under the seat portion carrier 12. Provided at the underside of the carrier 12 and at a distance x from the rearward end thereof is a pivot axis as diagrammatically indicated at 14, about which the carrier 12 and the carrier 10 are pivotable relative to each other. The pivot axis 14 may be formed for example by a shaft or spindle, the ends of which are slidably guided in a stationary pair of rails 16 which extend inclinedly downwardly towards the front end of the seat, that is to say towards the left in FIG. 1, being therefore the direction in which the occupant of the seat will face when sitting in a normal position in the seat. The free end of the limb 10*a* of the carrier 10, which is at a spacing from the pivot axis 14, is further guided by means of guide projections 18 which may also carry guide rollers, in a further stationary pair of rails 20. As can clearly be seen from FIG. 1, the rails 20 extend inclinedly upwardly towards the front end of the seat, towards the left in FIG. 1.

Disposed at the end of the pair of rails 20 is a stationary support means 22 on which the carrier 12 is supported at its forward end. The support means 22 may preferably be in the form of a rotatable roller or roller assembly.

FIG. 1 shows the carrier 10 and the carrier 12 in solid lines in the generally upright position of the seat according to the invention while the broken lines shown the carrier 10 and the carrier 12 in a reclining position of the seat of the invention, that is to say, the position of the seat in which the backrest portion is set at the greatest angle of inclination rearwardly of the seat. It will be clear from FIG. 1 that, to adjust the angle of inclination of the backrest portion, the carrier 12 is moved forwardly, which can be easily done by a person sitting on the seat portion supported by the carrier 12. When that is done, the backrest portion with its carrier 10 is then positively inclined by a rearward pivotal movement, as shown. Therefore, when adjusting the position of the seat in that way, the top end of the carrier 10 of the backrest portion moves in the opposite direction, relative to the front end of the carrier 12 of the seat portion. The movement for varying the inclination of the backrest portion of the seat of the invention is therefore split up into two movements, in opposite directions, of the seat portion carrier 12 and the backrest portion carrier 10. That, inter alia, permits such a seat to be arranged in a compact and space-saving manner in rows in passenger conveyance vehicles such as aircraft and railway carriages, insofar as movement of the seat to produce a greater angle of inclination of the backrest portion does not involve just the backrest portion inclining rearwardly to a greater extent but also entails a forward movement of the seat portion, in other words, adjusting the backrest portion to a greater angle of inclination does not result in the backrest portion encroaching excessively on the space available for the occupant of the seat behind the seat whose backrest portion is being adjusted. Furthermore, when the angle of inclination of the backrest portion is adjusted, the centre of gravity of the seat configuration scaracely changes in position, by virtue of the inclining movement of the backrest portion being distributed between the two movements in opposite directions of the carrier 10 and the carrier 12, so that such a seat, when used for example as an office chair, does not require a support base assembly or pedestal structure which has legs extending outwardly to a very substantial distance in order to provide adequate support for the chair.

Figure 2A:
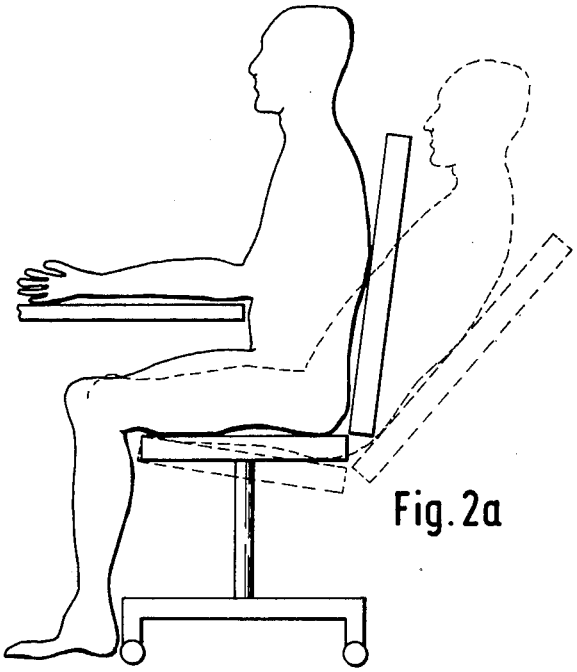
FIG. 2*a* shows the movement of an occupant of a conventional seat upon adjustment of the angle of inclination of the backrest portion thereof.
Figure 2B:
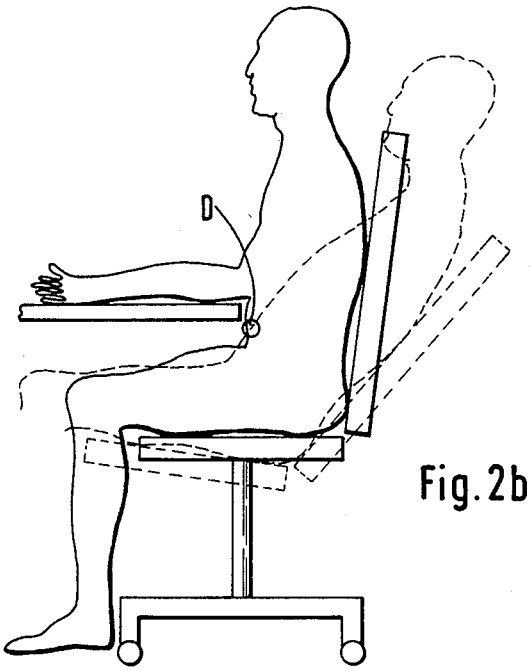
FIG. 2*b* is a similar view to FIG. 2*a*, showing the movement of an occupant of the seat according to the invention upon adjustment of the angle of inclination of the backrest portion thereof.

A further advantage which is achieved by virtue of the inclining movement of the backrest portion being divided up and distributed between two movements in opposite directions can be seen from a comparison between FIG. 2*a* and FIG. 2*b*. FIG. 2*a* shows adjustment of the inclination of the backrest portion in a conventional seat in which the backrest portion is pivotally connected to the seat portion at the rearward edge of the latter and at the bottom edge of the former. In such a seat, the inclining movement of the backrest portion is not divided up into the two oppositely directed movements of the seat portion and the backrest portion, as discussed above in relation to FIG. 1. The result of that, as can be seen from FIG. 2*a*, is that the occupant of the seat moves away from a working surface such as a desk, when the angle of inclination of the backrest portion is increased, moving from the solid-line position to the broken-line position. The point of rotary movement about which the upper body of the occupant of the seat moves during such adjustment of the backrest portion to an increased angle of inclination therefore also moves with the rearwardly directed movement of the backrest portion.

However, the situation is fundamentally different in regard to the seat according to the invention, as can be seen from FIG. 2*b*. The rearwardly directed movement of the backrest portion is so-to-speak compensated by the forwardly directed movement of the seat portion carrier 12 so that the point of rotary movement of the upper body of the occupant of the seat scarcely moves when the angle of inclination of the backrest portion is adjusted, remaining in the vicinity of and at the approximate level of the abdomen of the occupant, close to the working surface or desk. The location of the point of rotary movement of the occupant of the seat in FIG. 2*b* is indicated by reference letter D. That location and the movement thereof upon adjustment of the backrest portion is determined by the configuration and arrangement of the respective pair of rails 16 and 20 in which the carrier 10 is guided at two spaced-apart points as indicated at 14 and 18 in FIG. 1. If for example the seat structure according to the invention is to be used as a driver's seat in a motor vehicle, then the point D is positioned, by a suitable configuration and arrangement of the pairs of rails 16 and 20, in such a way that in the normal driving posture, the point D is in the region of the arm joints of the driver so that when the driver adjusts the angle of inclination of the seat, the driver does not have to pull in or stretch out his or her arms and thus remains in substantially the same position relative to the steering wheel, whatever the position of adjustment of the backrest portion of the seat. Hitherto, in the case of conventional driving seats, it was necessary for the seat to be adjusted in the fore-and-aft direction in order to compensate for the variation in the angle of inclination of the backrest portion.

The spacing x shown in FIG. 1 of the axis 14 from the rearward end of the carrier 12 provides that the point of rotary movement as between the limb 10*b* of the carrier 10 and the seat portion carrier 12 is in a region in which the point of rotary movement of the back of the occupant of the seat is to be found, upon a change in the inclination of the back of the occupant of the seat. That substantially overcomes the problem that, when the occupant of a seat of conventional kind inclines the backrest portion rearwardly and remains sitting in the seat with his or her back resting against the backrest portion of the seat, there is a tendency for an item of clothing such as a shirt or blouse which is tucked for example into the waistband of an article of clothing such as a pair of trousers or a skirt to be pulled out. That effect which occurs in the case of seats whose point of rotary movement is at the rearward end of the seat portion as shown in FIG. 2*a* is because the point of rotary movement of the back of the occupant of the seat is disposed at the buttocks or pelvic area at a spacing from the backrest portion of the seat, so that a point on the back of the occupant of the seat, upon an adjustment in the angle of inclination of the backrest portion, describes a larger radius about the point of rotary movement of the occupant's back, than the same point on the backrest portion of the seat, about the point of rotary movement of the backrest portion carrier frame.

It should also be noted that the seat according to the invention provides for adjustment of the angle of inclination of the backrest portion without the occupant of the seat having to perform any manual operating manoeuvres for that purpose. On the contrary, the occupant of the seat can adjust the angle of the backrest portion simply by shifting his or her body on the seat. Furthermore, the structure of the seat according to the invention provides that the occupant's back is firmly and rigidly supported in any position of inclination when the occupant of the seat does not shift his or her body on the seat.

It should be noted at this point that the pairs of rails 16 and 20 which are shown separately from each other in FIG. 1 may also be provided in the form of a single continuous pair of rails, as will be readily apparent, while still affording the above-indicated advantages of the invention.

It will be appreciated that the seat in accordance with the invention may be of a suitable design configuration as an office chair, a vehicle or driving seat, or any other kind of seat or chair. A wide range of variations therein can also be produced, on the basis of knowledge of the man skilled in the art. It will be noted however that the underlying consideration is that, for the purposes of adjusting the angle of inclination of the backrest portion, the ends of the pivot axis 14 which is common to the carrier 10 and the carrier 12 are guided in a first elongate guide means such as the pair of rails 16 and the limb 10*b* of the carrier 10 which extends under the carrier 12 is guided at a second elongate guide means such as the pair of rails 20, at a spacing from the pivot axis 14, in such a way that upon a forward movement of the carrier 12 the free end or top end of the limb 10*b* of the carrier 10 moves in the opposite direction and downwardly.

Reference will now be made to FIGS. 3 through 7 showing a seat in accordance with the invention which is designed for use, by way of example, as a seat for a railway carriage. The seat illustrated in FIGS. 3 through 7 can be used both in a situation in which a plurality of seats are arranged in one or more rows, with seats one behind the other, and also in a situation in which the seats are arranged as closely as possible to a wall of a carriage compartment, with the back portion of the seat backing on to the compartment wall.

Figure 3:
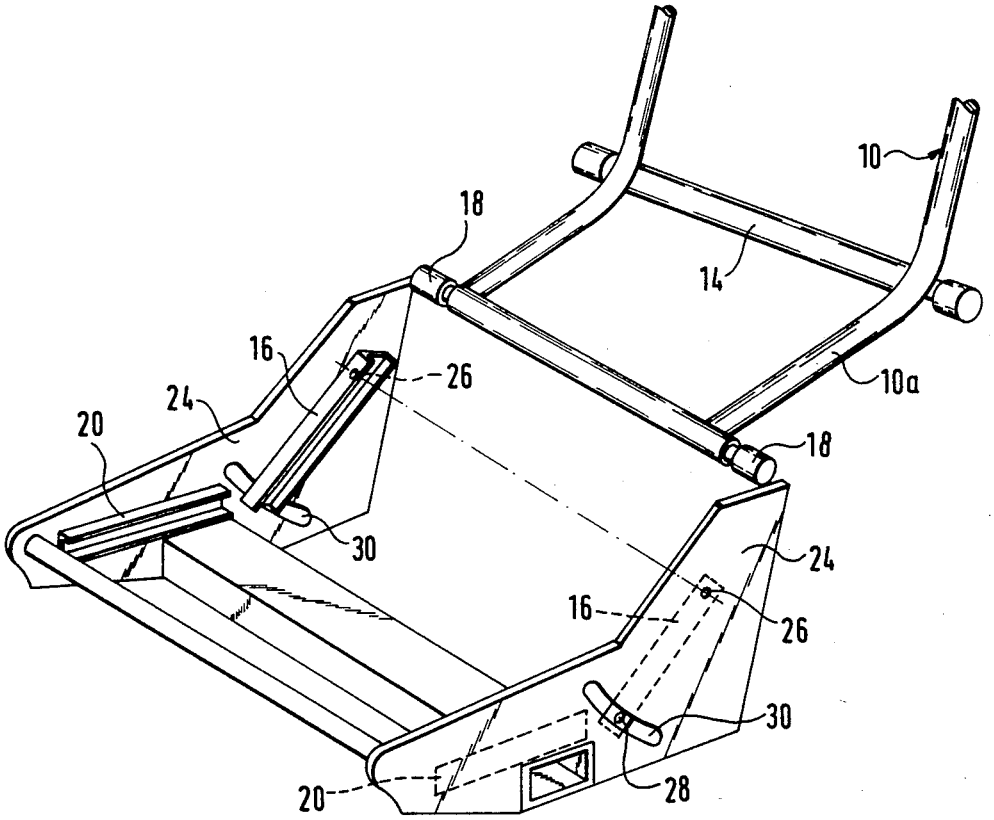
FIG. 3 is a diagrammatic perspective view of a support frame structure for a seat according to the invention which can be used for example as a railway seat.

Referring therefore to FIG. 3, the illustrated seat comprises a main or base frame structure 24 which is to be secured for example to the floor of a railway compartment and which carries the first and second pairs of rails 16 and 20, as described above with reference to FIG. 1. In this embodiment the pair of rails 16 is pivotable about an axis as indicated at 26, at the upper ends of the rails 16. The lower ends of the rails 16 are guided by means of pins 28 in arcuately curved guide slots 30. The rails 16 can be locked in limit positions of their movements, at the two ends of each of the guide slots 30. The backrest portion carrier or frame structure 10 can be suitably connected to the frame structure 24 by the free end portions of its pivot axis spindle 14 being fitted into the pair of rails 16 so as to be slidable lengthwise thereof, while at the same time the guide projections 18 on the limb 10*a* of the carrier 10 slidably engage into the pair of rails 20.

Figure 4:
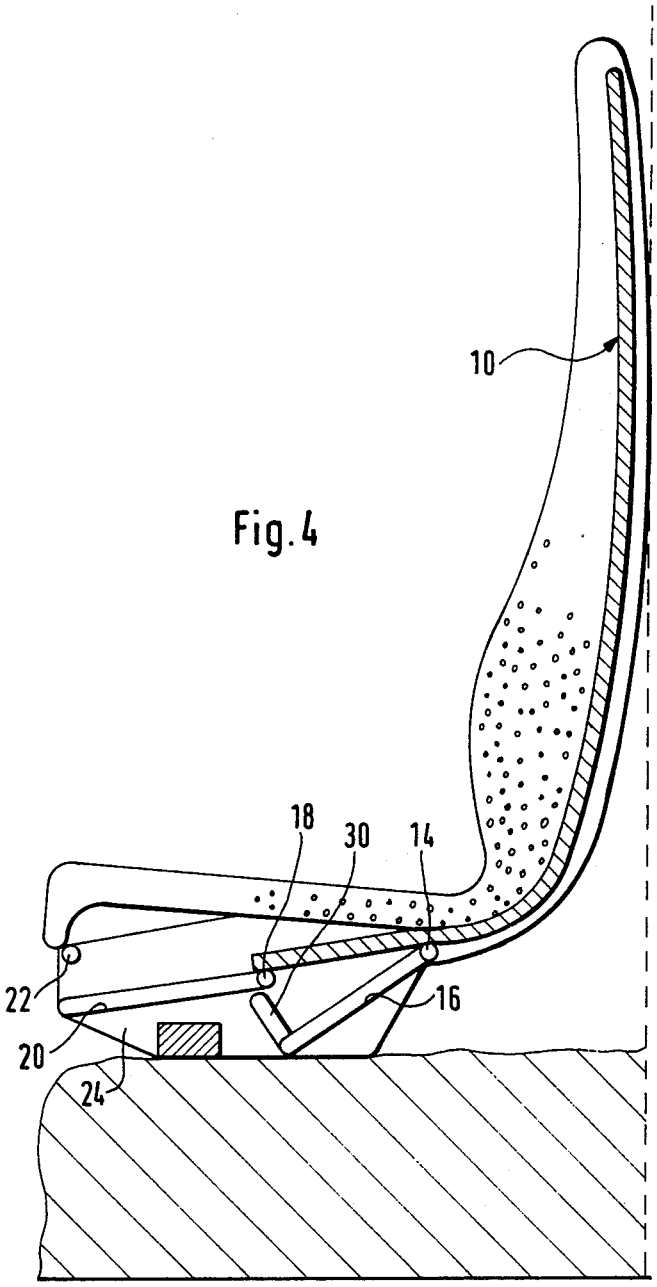
FIGS. 4 and 5 show two different positions of a seat in accordance with the invention when used for example as a railway carriage seat with a frame structure as shown in FIG. 3, in the situation where the seat is one of a row of seats disposed one behind the other.
Figure 5:
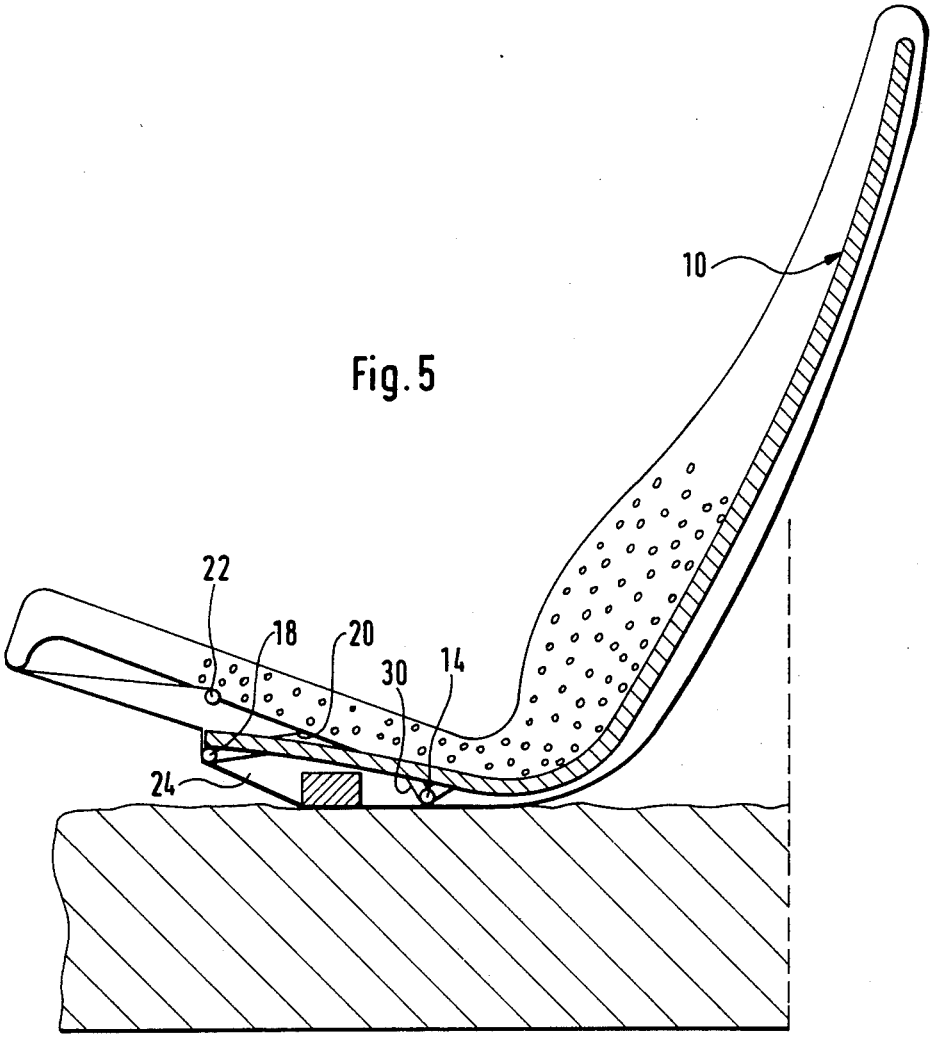
Figure 6:
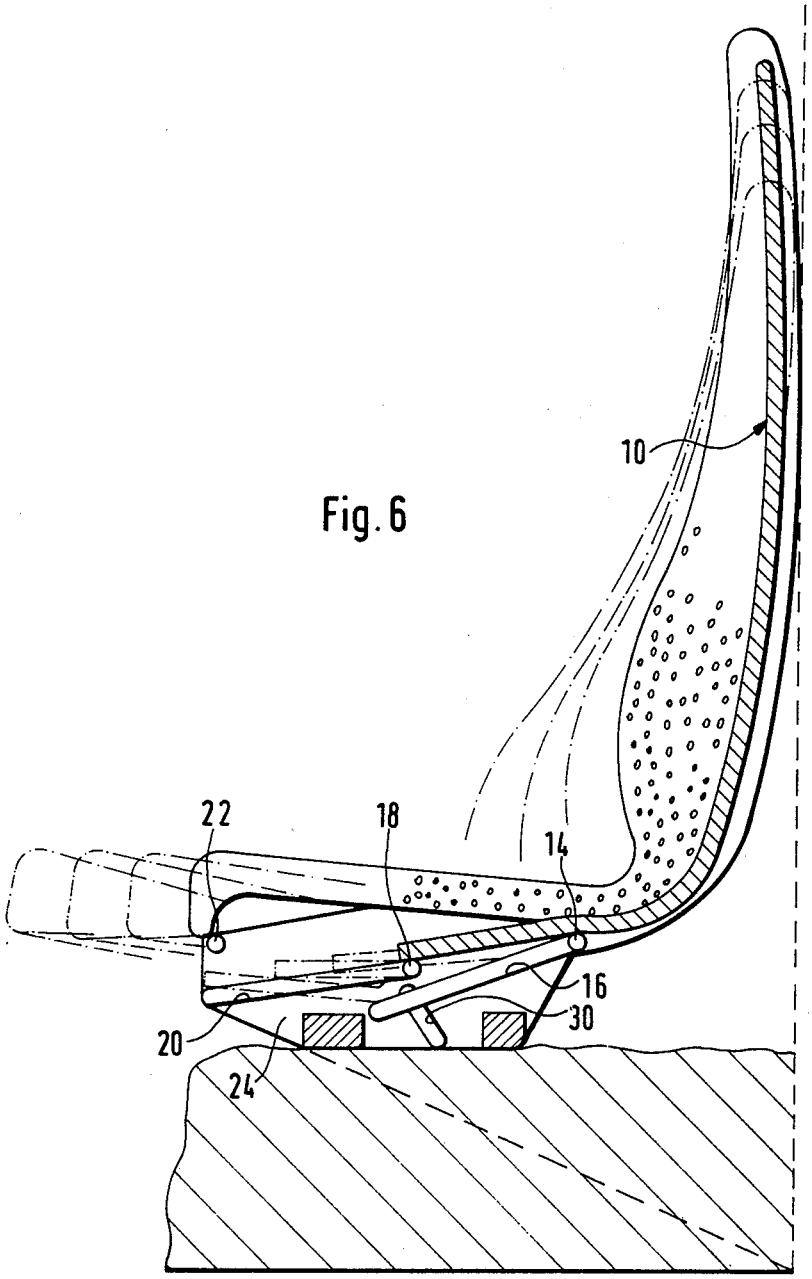
FIGS. 6 and 7 show two different positions of a seat according to the invention when used as a railway carriage seat with a frame structure as shown in FIG. 3, in the situation where the seat is used in a compartment with the back of the seat therefore disposed against a wall of the compartment.
Figure 7:
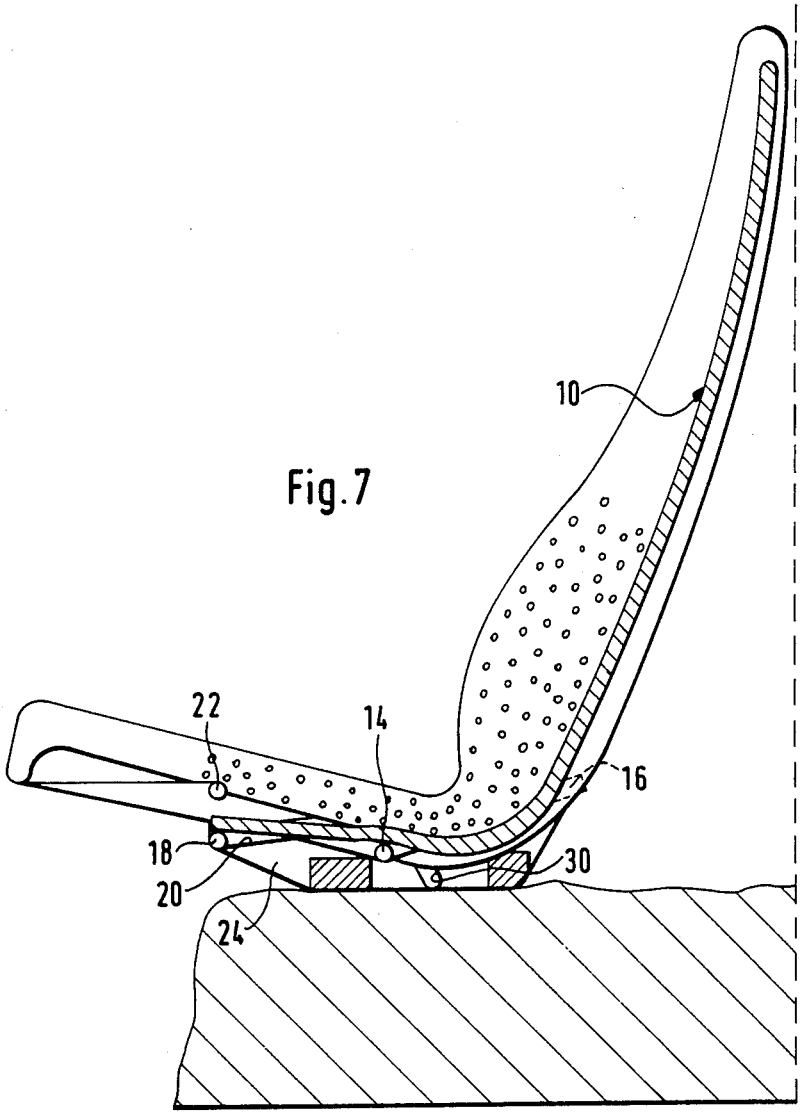

When the pair of rails 16 is in the lower position of its adjusting travel, with the pins 28 therefore bearing against the ends of the respective guide slots 30 which are downwards and towards the right in FIG. 3, the seat then operates in the manner described above, that is to say, the backrest portion thereof pivots in such a way that its top end is displaced rearwardly and downwardly when the seat portion of the seat is displaced forwardly, as can be seen from FIGS. 4 and 5. When the pair of rails 16 is in the above-indicated position, the illustrated seat can then be used as one of a row of seats, in other words, the seat is not positioned with its back against a compartment wall or the like. It may be noted at this point that the pair of rails 20 in FIGS. 3 through 7 extends downwardly towards the front of the seat, in contrast to the arrangement shown in FIG. 1 where the pair of rails 20 extends upwardly towards the front of the seat. The angles of inclination of the rails 16 and 20 will be chosen in dependence on the operating movements required of the seat.

When however the rails 16 of the structure shown in FIG. 3 are pivoted about the pivot axis 26 into the upper limit position in which therefore the pins 28 bear against the ends of the respective guide slots 30 which are upward and towards the left in FIG. 3, the pivot axis 14 is entrained forwardly of the seat, upon a forward movement of the seat portion thereof, to such an extent that the upper region of the backrest portion and carrier 10 can no longer move rearwardly but on the contrary moves substantially downwardly along a generally vertical path of movement. That form of movement of the seat can be clearly seen from a comparison between FIGS. 6 and 7. In that case therefore the seat can be used in for example a railway compartment where the back of the seat is against a compartment wall.

It will be seen therefore that that form of the seat according to the invention has an enhanced versatility of use, by virtue of a simple design feature, namely the easy adjustability of the rails 16.

It will be appreciated that the above-described constructions have been set forth solely by way of example of the principles of the present invention and that various modifications may be made therein without thereby departing from the spirit and scope of the invention.

What is claimed is:

1. A seat comprising: a seat carrier means; a backrest carrier means having first and second limb portions defining a generally L-shaped configuration in side view, the first limb portion of the backrest carrier means extending under the seat carrier means; first rail means disposed at the underside of the seat carrier means; a pivot axis means on said first limb portion of said backrest carrier means and engaged in said first rail means pivotably and slidably therein; a guide means disposed at the underside of said seat carrier means at a spacing from said pivot axis means; and mounting means on said first limb portion of the backrest carrier means, guided at said guide means in such a way that upon a forward movement of said seat carrier means the free end of said second limb portion of said backrest carrier means moves in the opposite direction and downwardly.

2. A seat as set forth in claim 1 wherein said pivot axis means between said seat carrier means and said backrest carrier means is spaced from the rearward end of said seat carrier means by a distance such that the point of rotation between said second limb portion of said backrest carrier means and said seat carrier means is in a region in which the point of rotation of the back of an occupant of the seat is to be found upon a change in the angle of inclination of the back portion of the seat.

3. A seat as set forth in claim 1 wherein said guide means for guiding said first limb portion of said backrest carrier means comprises second rail means.

4. A seat as set forth in claim 3 wherein said first rail means and said second rail means comprise respective pair of rails in opposite relationship at respective sides of said seat carrier means.

5. A seat as set forth in claim 1 and further including a guide assembly for guiding said seat carrier means at a location spaced from said pivot axis means of said seat carrier means and said backrest carrier means.

6. A seat as set forth in claim 5 wherein said guide assembly comprises a stationary support means on which said seat carrier means lies with its end remote from said pivot axis means.

7. A seat as set forth in claim 6 wherein said support means includes a support roller.

8. A seat as set forth in claim 3 wherein said backrest carrier means carries guide projections engaging into said rail means.

9. A seat as set forth in claim 8 wherein said projections include guide rollers engaging into said rail means.

10. A seat frame assembly for a seat having a support structure for supporting a seat portion and a backrest portion, comprising: a first frame means for carrying the seat portion of the seat; a second frame means for carrying the backrest portion of the seat, the second frame means comprising first and second limb parts which define a generally L-shaped configuration in side view of the seat frame assembly, the first limb part of said second frame means having at least a portion thereof which extends beneath said first frame means at a spacing from the underside thereof in the position of use of the seat frame assembly; first elongate guide means at the underside of said first frame means and extending in the fore-and-aft direction of said first frame means; first mounting means carried on said first limb part of said second frame means and having portions adapted to co-operate with said first elongate guide means slidably lengthwise thereof while also being rotatable with respect thereto thereby to permit pivotal movement of said second frame means relative to said first frame means about said portions co-operating with said first elongate guide means; second elongate guide means at the underside of said first frame means and extending in the fore-and-aft direction thereof, at a spacing from said first elongate guide means; and second mounting means on said first limb part of said second frame means at a spacing from said first mounting means and having portions adapted to co-operate with said second guide means slidably lengthwise thereof, the first and second elongate guide means extending at different angles from each other relative to the general plane of said first frame means such that upon a forward movement of said first frame means on said support structure of the seat said second frame means is moved towards a position of increased inclination of said backrest portion and upon a rearward movement of said first frame means said second frame means is moved towards a position of reduced inclination of said backrest portion.

11. A seat frame assembly as set forth in claim 10 wherein said first and second elongate guide means are in interconnecting relationship.

12. In a seat, a seat frame assembly as set forth in claim 10 and further including a seat portion on said first frame means and a backrest portion on said second frame means.

13. A seat comprising: a seat carrier means; a backrest carrier means having first and second limb portions defining a generally L-shaped configuration in side view, the first limb portion of the backrest carrier means extending under the seat carrier means; first rail means disposed at the underside of the seat carrier means; means for adjusting the angle of inclination of said first rail means; a pivot axis means on said first limb portion of said backrest carrier means and engaged in said first rail means pivotably and slidably therein; a guide means disposed at the underside of said seat carrier means at a spacing from said pivot axis means; and mounting means on said first limb portion of the backrest carrier means, guided at said guide means in such a way that upon a forward movement of said seat carrier means the free end of said second limb portion of said backrest carrier means moves in the opposite direction and downwardly.

14. A seat comprising:

a seat portion;

a generally L-shaped backrest portion including first and second integral limbs, said first limb extending beneath said seat portion and said second limb generally behind said seat portion;

means for connecting said seat portion to said backrest portion; and means for moving said seat portion forward as said second limb moves downwardly and rearwardly such that a pivot point about which an occupant of the seat pivots when adjusting the inclination of said backrest portion remains at a substantially stationary location during said adjustment.

15. A seat as defined in claim 14 wherein said pivot point is approximately in the lower chest area of an occupant of said seat.

16. A seat as defined in claim 14 including a base, a first pair of opposing rails pivotably mounted to said base, a second pair of opposing rails mounted to said base, first guide means connected to said backrest portion and engaged in said first pair of opposing rails, and second guide means connected to said backrest portion and engaged in said second pair of opposing rails.

* * * * *